US006554582B1

(12) United States Patent
Belec

(10) Patent No.: US 6,554,582 B1
(45) Date of Patent: Apr. 29, 2003

(54) HIGH PRESSURE PUMP WITH IMPROVED HUB

(75) Inventor: Alain Belec, Fresnes (FR)

(73) Assignees: Peugeot Automobiles SA, Neuilly sur Seine (FR); Siemens VDO Automotive, Toulouse (FR)

( * ) Notice: Subject to any disclaimer, the term of this patent is extended or adjusted under 35 U.S.C. 154(b) by 0 days.

(21) Appl. No.: 10/009,364

(22) PCT Filed: May 29, 2000

(86) PCT No.: PCT/FR00/01466

§ 371 (c)(1),
(2), (4) Date: Dec. 10, 2001

(87) PCT Pub. No.: WO00/75515

PCT Pub. Date: Dec. 14, 2000

(30) Foreign Application Priority Data

Jun. 8, 1999 (FR) ..... 99 07215

(51) Int. Cl.[7] ..... F04B 1/12; F04B 9/08

(52) U.S. Cl. ..... 417/269; 417/390; 417/387; 417/383; 92/57; 123/446

(58) Field of Search ..... 417/269, 390, 417/387, 383, 222.2; 92/57; 123/446; 384/586

(56) References Cited

U.S. PATENT DOCUMENTS

| | | | | |
|---|---|---|---|---|
| 2,381,056 A | | 8/1945 | Huber | 417/269 |
| 3,143,973 A | | 8/1964 | Budzich | 92/57 |
| 3,775,030 A | | 11/1973 | Wanner | 417/388 |
| 4,221,545 A | | 9/1980 | Terauchi | 417/269 |
| 5,354,181 A | * | 10/1994 | Porel | 417/269 |
| 5,554,008 A | * | 9/1996 | Porel | 417/269 |
| 6,264,437 B1 | * | 7/2001 | Porel | 417/390 |

FOREIGN PATENT DOCUMENTS

| | | |
|---|---|---|
| FR | 1096453 | 6/1955 |
| FR | 2 716 239 | 8/1995 |
| WO | WO 97/47883 | 12/1997 |

* cited by examiner

*Primary Examiner*—Charles G. Freay
*Assistant Examiner*—Michael K. Gray
(74) *Attorney, Agent, or Firm*—Connolly Bove Lodge & Hutz LLP

(57) ABSTRACT

A pump has a main unit (18) for pumping a transferred liquid which is actuated by an secondary unit (20) which pumps a working liquid. The secondary unit (20) has a hub (64) which is rotably mounted in a housing (16). The hub has a cylindrical guiding surface (SG) which is rotatable in the housing. A shoulder (FE) axially positions the hub in the housing. The guiding surface and shoulder cooperate with rotation guiding and axial positioning elements on the housing. The hub connects to a swashplate (62) which actuates a piston (54).

9 Claims, 10 Drawing Sheets

HIGH PRESSURE PUMP WITH IMPROVED HUB

The present invention relates to a high-pressure pump with improved hub.

It applies in particular to a high-pressure pump for supplying a motor vehicle internal combustion engine with fuel. In this case, the transferred liquid is fuel.

The state of the art already knows a high-pressure pump for pumping a first liquid, known as the transferred liquid, of the type comprising a main unit for pumping the transferred liquid, which unit is actuated by a secondary unit for pumping a second liquid, known as the working liquid, the secondary unit comprising a hub mounted so as to rotate in a housing forming a bearing, and at least one piston for compressing the working liquid, which can move approximately parallel to the axis of rotation of the hub, returned elastically against a swashplate for actuating this piston, carried by the hub.

A pump of this type is described for example in WO 97/47883.

The hub of the pump described in the above document is mounted so as to rotate in the housing by means of ball bearings which rotationally guide and axially position the hub in the housing. These ball bearings have the drawbacks of being bulky, relatively heavy and expensive and sometimes sources of noise.

It is an object of the invention to propose a high-pressure pump of the aforementioned type having means for rotationally guiding and axially positioning the hub in the housing which are effective, simple and compact.

To this end, the subject of the invention is a high-pressure pump of the aforementioned type, characterized in that the hub comprises a peripheral cylindrical surface for guiding the rotation in the housing, extended by a shoulder for axially positioning the hub in the housing, the peripheral guide surface and the axial positioning shoulder cooperating respectively with complementary rotational guiding means and complementary axial positioning means carried by the housing, the axial positioning shoulder being urged against the complementary axial positioning means carried by the housing and by the elastic return force of the piston and the pressure of the working liquid in contact with the swashplate.

According to other features of this pump:

- the peripheral guide surface is formed by the external surface of a sleeve, the axial positioning shoulder being formed by one face of a ring attached to this sleeve;
- the peripheral guide surface and the axial positioning shoulder are formed by the external surface of a stepped tubular member made as a single piece;
- the peripheral guide surface is formed by the external surface of a sleeve, the axial positioning shoulder being delimited by a collar extending one end of this sleeve;
- the complementary rotational guiding means comprise a cylindrical bearing surface in sliding contact with the peripheral guide surface for the hub and the complementary axial positioning means comprise a flat bearing surface in sliding contact with the shoulder;
- the cylindrical bearing surface is formed by the internal surface of a liner of the housing, the flat bearing surface being formed by a washer arranged at one end of the liner;
- the cylindrical bearing surface is formed by the internal surface of a sleeve, the flat bearing surface being delimited by a collar extending one end of the sleeve;
- the complementary rotational guiding means comprise rolling bearing needles, carried by the housing running more or less parallel to the axis of rotation of the hub, and the complementary axial positioning means comprise rolling bearing needles, carried by the housing, running more or less radially with respect to the axis of rotation of the hub; and
- the transferred liquid is a fuel for a motor vehicle internal combustion engine.

The invention will be better understood from reading the description which will follow which is given solely by way of example and made with reference to the drawings in which.

Figure 1:
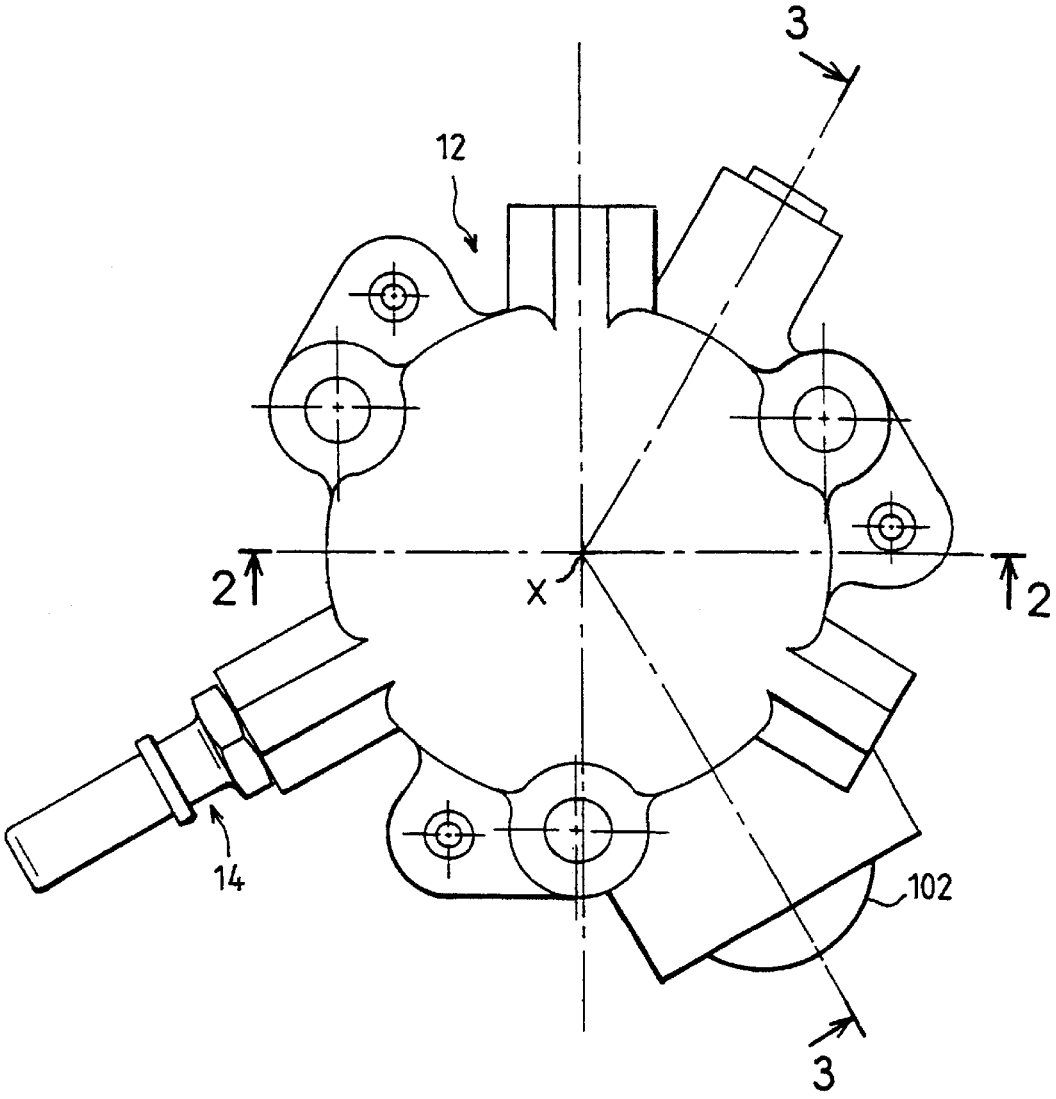
FIG. 1 is a front view of a high-pressure pump according to the invention.
Figure 2:
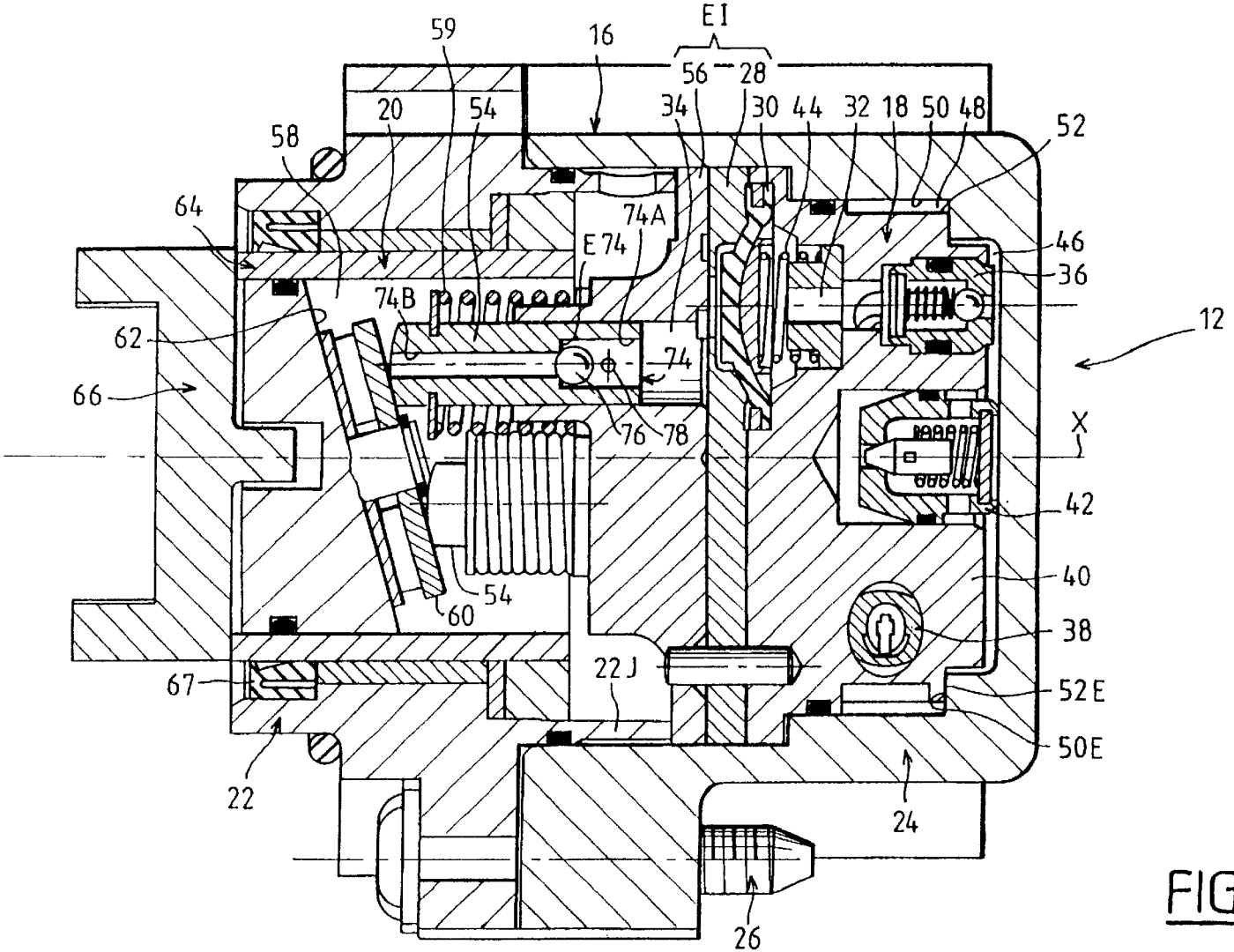
FIG. 2 is a view in section on 2—2 of FIG. 1.
Figure 3:
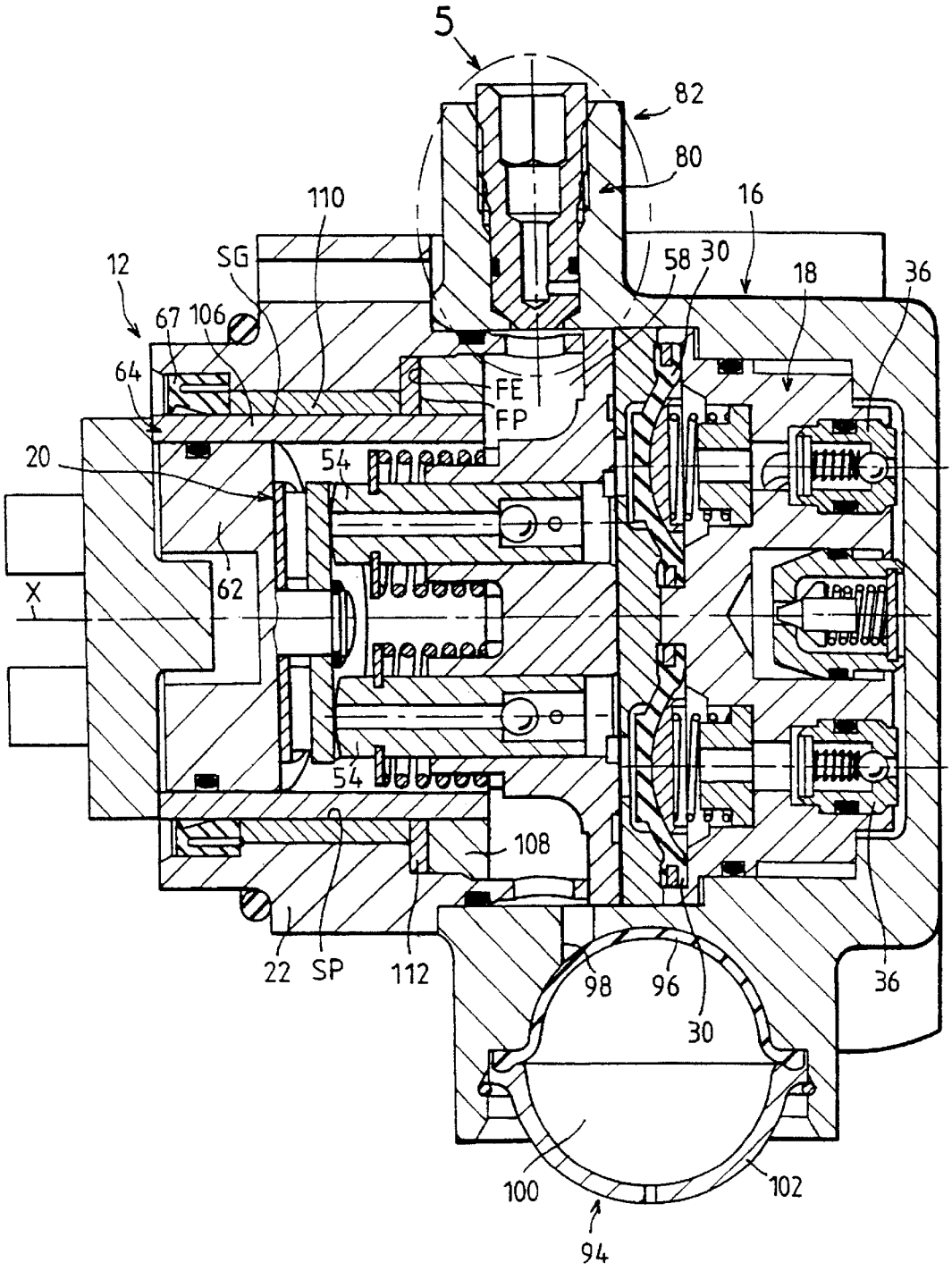
FIG. 3 is a view in section on 3—3 of FIG. 1.

FIGS. 1 to 3 depict a high-pressure pump according to the invention, denoted by the general reference 12. In the example described, the pump 12 is intended to supply high-pressure fuel to a motor vehicle internal combustion engine. The pump 12 is therefore intended to pump a first liquid, namely fuel, in the example described, known as the transferred liquid.

FIG. 1 shows a connector 14 intended to connect the pump 12 to a fuel tank.

Referring more specifically to FIGS. 2 and 3, it can be seen that the pump 12 has a housing 16 of cylindrical overall shape, with axis X, in which are arranged a main unit 18 for pumping fuel and a secondary unit 20 for pumping a conventional second liquid, for example a mineral oil, known as the working liquid. The main unit 18 is actuated by the secondary unit 20 according to conventional general operating principles described, for example, in WO 97/47883.

The housing 16 comprises a body 22, of cylindrical overall shape, surrounding the secondary unit 20, and a cover 24, of cylindrical overall shape, surrounding the main unit 18. The housing body 22 and the cover 24 respectively form two opposite ends of the housing 16.

The housing body 22 is connected to the cover 24 by at least one screw 26, for example three screws 26. Each screw 26, preferably made of steel, runs more or less 35 parallel to the axis X. A screw 26 will be described in greater detail later on.

Inside the housing 16, the main unit 18 is separated from the secondary unit 20 by a separation disk 28 centered more or less on the axis X. This disk 28 is preferably made of steel or cast iron.

The main unit 18 comprises at least one flexible diaphragm 30 for pumping fuel, for example three diaphragms 30 as in the example illustrated. It will be noted that just two diaphragms 30 are depicted in the figures, particularly in FIG. 3.

The diaphragm 30 separates a fuel-pumping chamber 32, arranged in the main unit 18, from a chamber 34 for compressing the working liquid, which chamber is arranged in the secondary unit 20. The volume of the pumping chamber 32 is variable. The compression chamber 34 is formed partially in the separation disk 28.

Associated with each pumping chamber 32 are a fuel intake valve 36 and a fuel delivery valve 38. These valves 36, 38, of conventional structure and operation, are carried by a body 40 housed in the cover 24 between an end thereof and the separation disk 28.

To lighten the pump 12, the body 22 of the housing, the cover 24 and the valve body 40 are made of aluminum or aluminum-based alloy or alternatively of some other equivalent lightweight metal.

The valves 36, 38 are connected in a way known per se to the corresponding pumping chamber 32 and to a safety valve 42 of conventional structure and operation.

In the conventional way, each diaphragm 30 can be moved between a first position in which the pumping chamber 32 has maximum volume, as depicted in particular in FIGS. 2 and 3, and a second position in which this pumping chamber has minimum value (not depicted in the figures). The movements of the diaphragm 30 are imparted, in particular, by the secondary unit 20 and drive the opening and closure of the fuel intake and delivery valves 36, 38.

Each diaphragm 30 is constantly elastically returned to its first position by a spring 44 known as a diaphragm spring.

Each valve 36, 38 communicates, on the one hand, with a fuel intake chamber 46 and, on the other hand, with a fuel delivery chamber 48. The intake chamber 46 is connected in a way known per se to the fuel supply connector 14.

The fuel intake 46 and delivery 48 chambers are delimited, at least partly, by surfaces 50, 52 facing each other, of cylindrical overall shape, with an axis that more or less coincides with the axis X. A first surface 50 forms an internal surface of the cover 24. The second surface 52 forms a peripheral surface of the valve body 40.

The facing surfaces 50, 52 comprise two complementary shoulders 50E, 52E resting together to form a sealed joining plane separating the intake 46 and delivery 48 chambers. This joining plane is more or less at right angles to the axis X. The shoulders 50E, 52E form an effective metal-to-metal seal.

It will be noted that the intake chamber 46, in which the pressure is lower than it is in the delivery chamber 48, is delimited by the end of the cover 24, the thickness of which is relatively small. By contrast, the delivery chamber 48 is delimited by a peripheral wall of the cover 24 which is thicker than the end of this cover, so as to withstand the high pressure reached by the fuel flowing through this delivery chamber.

the secondary unit 20 comprises a piston 54 for compressing the working liquid, which piston is associated with each diaphragm 30 and intended to move this diaphragm 30 between its two positions. Thus, in the example described, the secondary unit 20 has three pistons 54, just two of which are visible in the figures, particularly in FIG. 3.

The piston 54 is slidably mounted in a body 56, preferably made of steel or cast iron, so that it can be moved more or less parallel to the axis X. The piston 54 runs between the working liquid compression chamber 34, formed in part in the piston body 56, and a reservoir 58 of working liquid.

The end of the piston 54 external to the piston body 56 is elastically returned by a spring 59 into contact with a thrust rolling bearing, for example a thrust needle bearing 60, carried by a swashplate 62 for actuating the pistons 54. This swashplate is carried by a hub 64 of the secondary unit 20. This hub 64 is mounted so that it can rotate about the axis X in the housing body 22 which forms the bearing. The swashplate 62 rotates about the axis X together with the hub 64, the latter being connected to conventional drive means by a coupling 66 of the Oldham type. Sealing of the housing body 22 and the hub 64 against the working liquid is provided by conventional means comprising, in particular, an annular seal 67 made of elastomer. The hub 64 will be described in greater detail later.

It will be noted that the separation disk 28 and the piston body 56 form an intermediate assembly EI trapped axially between a skirt 22J of the housing body 22, internal to the cover 24, and the valve body 40.

Figure 4:
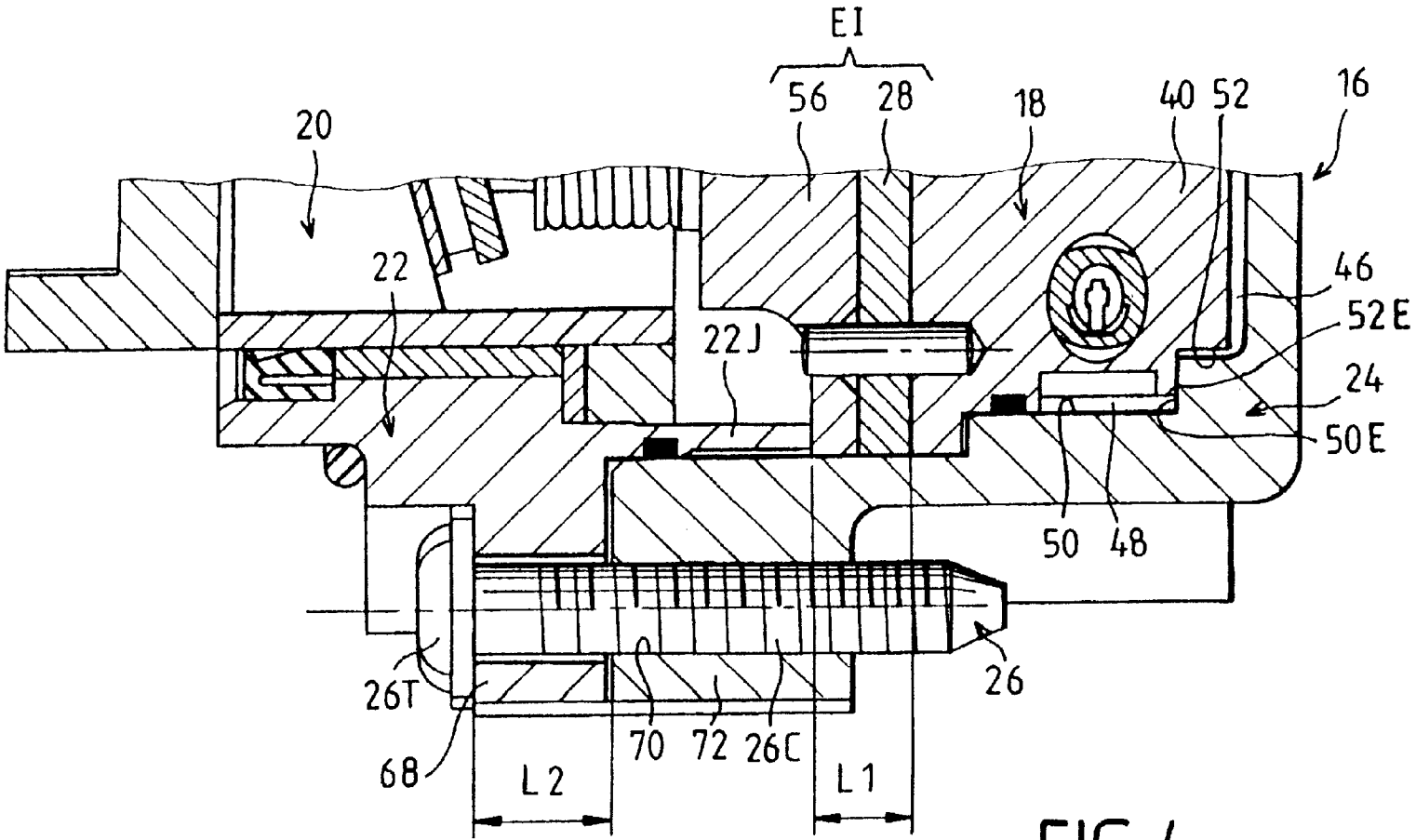
FIG. 4 is a detail view of FIG. 2, in which the plane of section has been offset slightly so that it passes through the axis of the screw depicted in these FIGS. 2 and 4.

Furthermore, referring in particular to FIG. 4, it an be seen that each screw 26 has a head 26T and a threaded body 26C. The head 26T rests against a passing seat 68 formed in the housing body 22. The threaded body 26C is screwed into a tapped orifice 70 formed in a lug 72 secured to the cover 24. Thus, the housing body 22, the intermediate assembly EI and the valve body 40 are trapped between the head 26T of the screw and the joining plane embodied by the shoulders 50E, 52E.

As a preference, the axial dimension L1 of the intermediate assembly EI is more or less equal to the length L2 of the part of the body 26C of the screw that runs between the head 26T of this screw and the tapped orifice 70. Thus, the expansions of the various materials, namely, on the one hand, the aluminum or the lightweight metal and, on the other hand, the steel or cast iron, are more or less identical inside and outside the housing 16.

Referring once again to FIGS. 2 and 3, it can be seen that the piston 54 has an axial drilling 74 through which the working liquid can circulate between the reservoir 58 and the compression chamber 34. A first end of the drilling 74, internal to the piston body 56, constantly communicates with the compression chamber 34. The second end of the drilling 74, external to the piston body 56, constantly communicates with the reservoir 58.

As a preference, the drilling 74 is stepped and has a large-diameter portion 74A opening into the compression chamber 34, and a small-diameter portion 74B opening into the reservoir 58.

A ball, forming a valve 76, is lodged in the large-diameter portion 74A so as to be moveable, on the one hand, between a shoulder E74 separating the portions 74A and 74B and forming a closure seat for the valve 76, and, on the other hand, a stop 78 limiting the opening travel of this valve 76.

The valve 76 opens as soon as the pressure of the working liquid in the reservoir 58 exceeds that of the working liquid in the compression chamber 34. When the reverse is true, the valve 76 closes to shut off the drilling 74.

For the pump 12 to operate correctly, the stiffness of the spring 44 that returns the diaphragm 30 associated with the piston 54 is dimensioned so that this spring 44 keeps the working liquid contained in the compression chamber 34 at a raised pressure with respect to the working liquid contained in the reservoir 58, and does so as long as the diaphragm 44 has not reached its first position in which the pumping chamber 32 has its maximum volume.

A few specific features of the operation of the main 18 and secondary 20 pumping units will be given hereinbelow, the main unit 18 operating according to the principles of a positive-displacement pump.

When the swashplate 62 pushes the piston 54 into the piston body 56 (movement of the piston 54 to the right when considering FIGS. 2 and 3), the working liquid contained in the compression chamber 34 is compressed (at a raised pressure with respect to the liquid contained in the reservoir 58), which means that the valve 76 closes and the flexible diaphragm 30 moves toward its second position in which the pumping chamber 32 has its minimum volume. This, as is conventional, brings about delivery of the high-pressure fuel in the delivery chamber 48. when the swashplate 62 allows the piston 74 to move in the opposite direction to the previous one (to the left when considering FIGS. 2 and 3) under the effect of the return spring 59, the diaphragm 30 is returned by the spring 44 to its first position in which the pumping chamber 32 has its maximum volume. This, as is conventional, causes fuel from the intake chamber 46 to be drawn into the pumping chamber 32.

It will be noted that the diaphragm spring 44 allows the diaphragm 30 to return automatically to its first position, even when there is no fuel in the main pumping unit 18. Furthermore, when the piston 54 moves to the left when considering FIGS. 2 and 3, given the leaks of working liquid between the compression chamber 34 and the reservoir 58, the diaphragm 30 reaches its first position before the piston 54 has completed its travel to the left. In consequence, once the diaphragm 30 has reached its first position, the pressure of the working liquid in the compression chamber 34 drops with respect to that of the working liquid in the reservoir 58, which causes the valve 76 to open and the compression chamber 34 to be resupplied with working liquid so as to compensate for the leaks.

Simple and effective means for completely filling the reservoir 58 with working liquid will be described hereinbelow with particular reference to FIGS. 3 and 5.

These filling means comprise a filling neck 80, connected to the reservoir 58, and which can be plugged by a plug 82.

Figure 5:
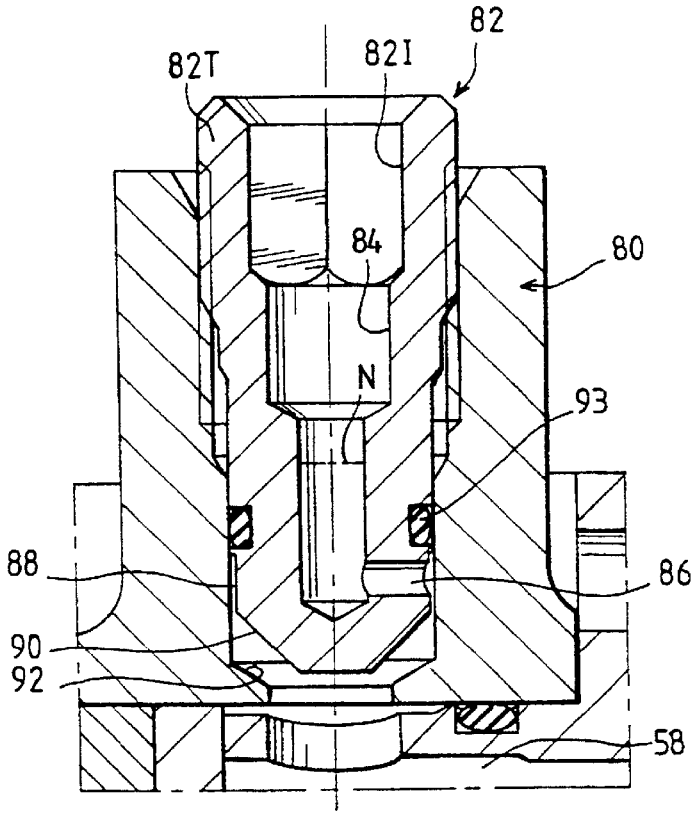
FIG. 5 is a detail view of the ringed part 5 of FIG. 3 showing a plug for plugging the means for filling a reservoir of the pump in a pre-plugging position.

In the example illustrated in FIGS. 3 and 5, the plug 82 is intended to collaborate by screwing with the neck 80. The plug 82 comprises a blind hole 84, more or less axial, communicating via a more or less radial drilling 86 of the plug with a peripheral counterbore 88 of the plug which is extended axially by a plugging surface 90 of this plug which is intended to collaborate with a plugging seat 92 formed in the end of the neck 80 nearest the reservoir 58.

As a preference, the plugging surface 90 and the plugging seat 92 have conical overall shapes, the plugging surface 90 converging toward the plugging seat 92.

The plug 82 can move in the neck 80, by screwing, between a position of preplugging the reservoir 58, in which position the plugging surface 90 is away from the seat 92, above this seat 92, as is depicted in FIG. 5, and a position of plugging this reservoir 58, in which position the plugging surface 90 is in sealed contact with the seat 92, as is depicted in FIG. 3.

The neck 80 is capable of containing an excess of working liquid overflowing from the reservoir, the overflow level N extending into the neck 90 above the seat 92.

It will be noted that when the plug 82 is in its preplugging position, the peripheral counterbore 88 of this plug communicates with the reservoir 58, which means that the blind hole 84 forms a receptacle for the overflow of working liquid. Furthermore, when there is overflow in the neck 80, the plug 82 can move in this neck between its preplugging and plugging positions.

To move the plug 82, the latter has a driving head 82T through which the open end of the blind hole 84 opens. The head 82T is delimited by a polygonal interior surface 82I allowing the plug 82 to be driven using a conventional tool.

Figure 6:
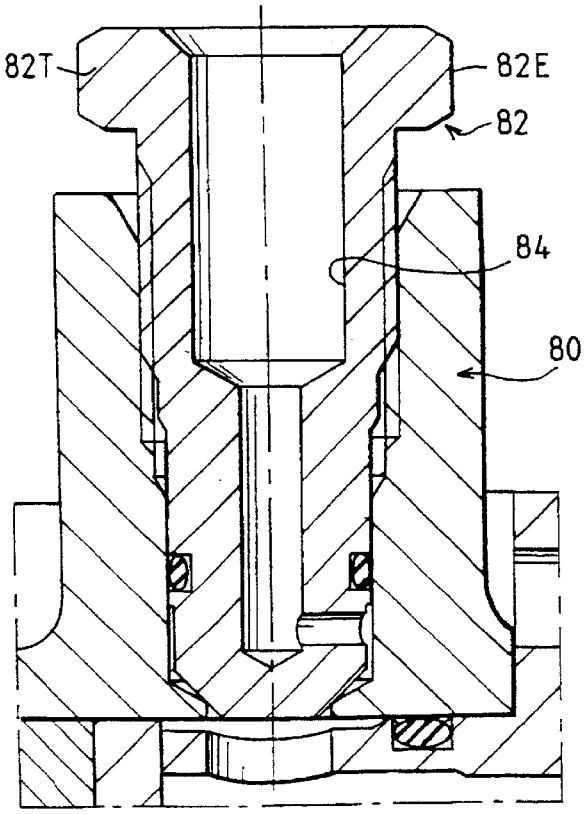
FIG. 6 is a view similar to FIG. 5 depicting a first alternative form of the plug.

As an alternative, the driving head 82T may be delimited by a polygonal exterior surface 82E as is depicted in FIG. 6, so that the plug 82 can be driven using a conventional tool.

The plug 82 carries a peripheral O-ring 93 positioned axially between the head 82T and the counterbore 88. This O-ring 93 provides sealing between the neck 80 and the plug 82 above the counterbore 88.

The plug 82 allows the reservoir 58 to be filled under vacuum as follows.

Initially, the plug 82 is screwed into the neck 80 in its preplugging position as depicted in FIG. 5.

To fill the reservoir 58 with working liquid, a vacuum is pulled in this reservoir, using conventional means, then the working liquid is introduced through the blind hole 84 of the plug. In this way, the working liquid flows into the reservoir 58, flowing through the blind hole 84, the radial drilling 86 and the counterbore 88. The reservoir 58 continues to be filled until overflow is left in the neck 80 and the blind hole 84, as depicted in FIG. 5.

Finally, with overflow present, the plug 82 is screwed in to its plugging position as depicted in FIG. 3. The reservoir 58 is therefore isolated from the filling neck 80, the quantity of working liquid remaining in the blind hole 84 being easily removed via that end of the blind hole 84 that opens through the driving head 82T.

Referring to FIG. 3, it can be seen that the reservoir 58 is connected to conventional means 94 for compensating for the expansion of the working liquid contained in the reservoir 58. These means comprise a flexible diaphragm 96 separating a duct 98 for placing the diaphragm 96 in communication with the working liquid of the reservoir 58 from a clearance space 100 for the diaphragm 96, which space is protected by a shell 102 of hemispherical overall shape. The diaphragm 96 deforms according to the variations in volume of the working liquid contained in the reservoir 58.

Figure 7:
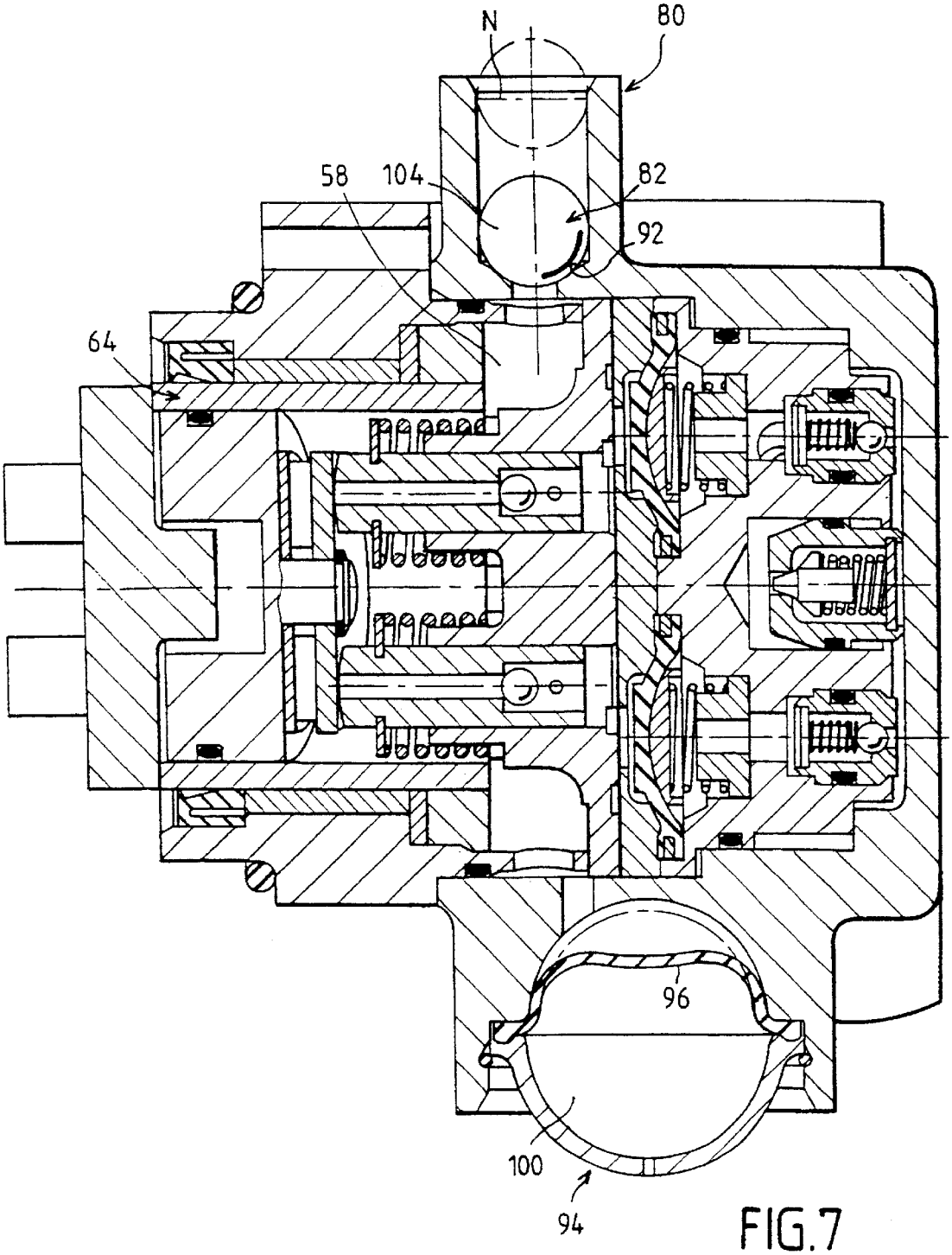
FIG. 7 is a view similar to FIG. 3 depicting a second alternative form of the plug.

FIG. 7 depicts an alternative form of the plug 82.

In this case, the plug 82 comprises a ball 104 that can be moved by force between a position of preplugging the reservoir 58, as depicted in chain line in FIG. 7, and a position of plugging this reservoir 58, as depicted in solid line in this FIG. 7.

The surface of the ball 104 forms the plugging surface intended to collaborate in a sealed fashion with the seat 92 of the neck.

The filling neck 80 is plugged as follows by means of the ball 104. When overflow working liquid is present, the level N of which is depicted in chain line in FIG. 7, the ball 104 is placed in its preplugging position as depicted in chain line in this FIG. 7. The ball 104 is then forcibly moved in the neck 80 so as to press it against the seat 92, as depicted in solid line in FIG. 7.

It will be noted that while the ball 104 is being forcibly moved between the positions in which it preplugs and plugs the reservoir 58, the overflow of working liquid forcibly introduced into the reservoir 58 under the effect of the movement of the ball 104 is compensated for by the deformation of the diaphragm 96 of the expansion compensation means 94, as depicted in FIG. 7.

The hub 64 will be described hereinbelow in greater detail with reference to FIG. 3.

In the example illustrated in this FIG. 3, the hub 64 comprises a sleeve 106, the axis of which coincides with the axis X, in which sleeve the swashplate 62 is housed.

The hub 64 also comprises a ring 108 fixed to the outer surface of the sleeve 106.

The outer surface of the sleeve 106 forms a peripheral cylindrical surface SG for guiding the rotation of the hub in the housing body 22. One face of the ring 108 forms a shoulder FE for axially positioning the hub 64 with respect to the housing body 22.

Furthermore, the housing body 22 comprises a liner 110, the internal surface of which forms a cylindrical bearing surface SP in sliding contact with the peripheral guide surface SG for the hub.

The housing body 22 also comprises a washer 112, arranged at one end of the liner 110, equipped with a face forming a flat bearing surface FP in sliding contact with the shoulder FE of the hub.

The liner 110 and the washer 112 are fixed in a way known per se to the housing body 22 and are manufactured from conventional materials, preferably materials with a low coefficient of friction.

It will be noted that the shoulder FE of the hub 64, extending the guide surface SG for this hub, is urged against the bearing surface FP of the housing body 22 by the elastic return force of the pistons 54 upon contact with the thrust needle bearing 60 and by the pressure of the working liquid in contact with the swashplate 62.

Figure 8:
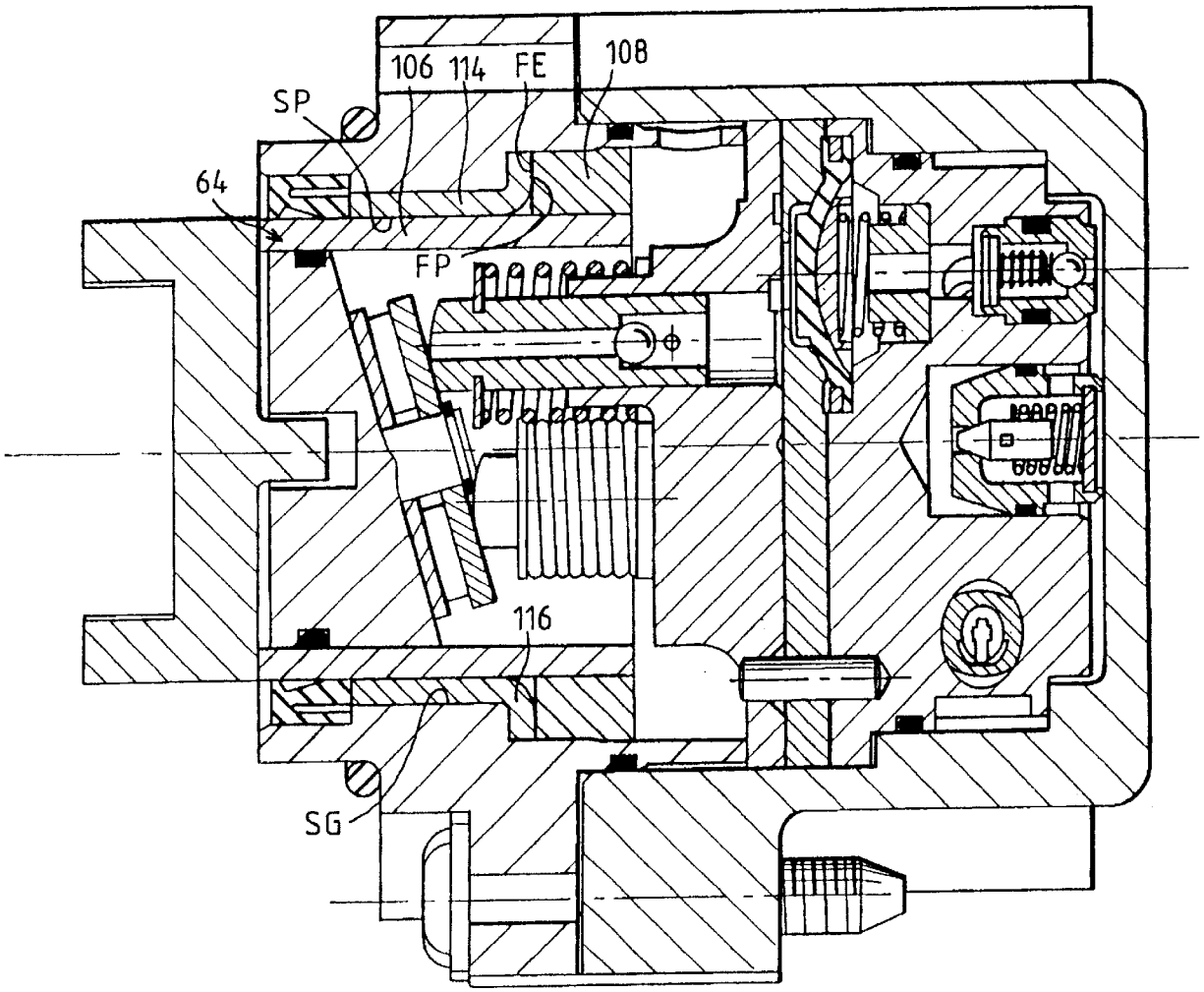
FIGS. 8 to 11 are views similar to FIG. 2 depicting four respective alternative forms of a hub of the pump according to the invention.

According to a first alternative form depicted in FIG. 8, the cylindrical bearing surface SP is formed by the internal surface of a sleeve 114, carried by the housing body 22, equipped with an end extended by a collar 116 delimiting the flat bearing surface FP.

Figure 9:
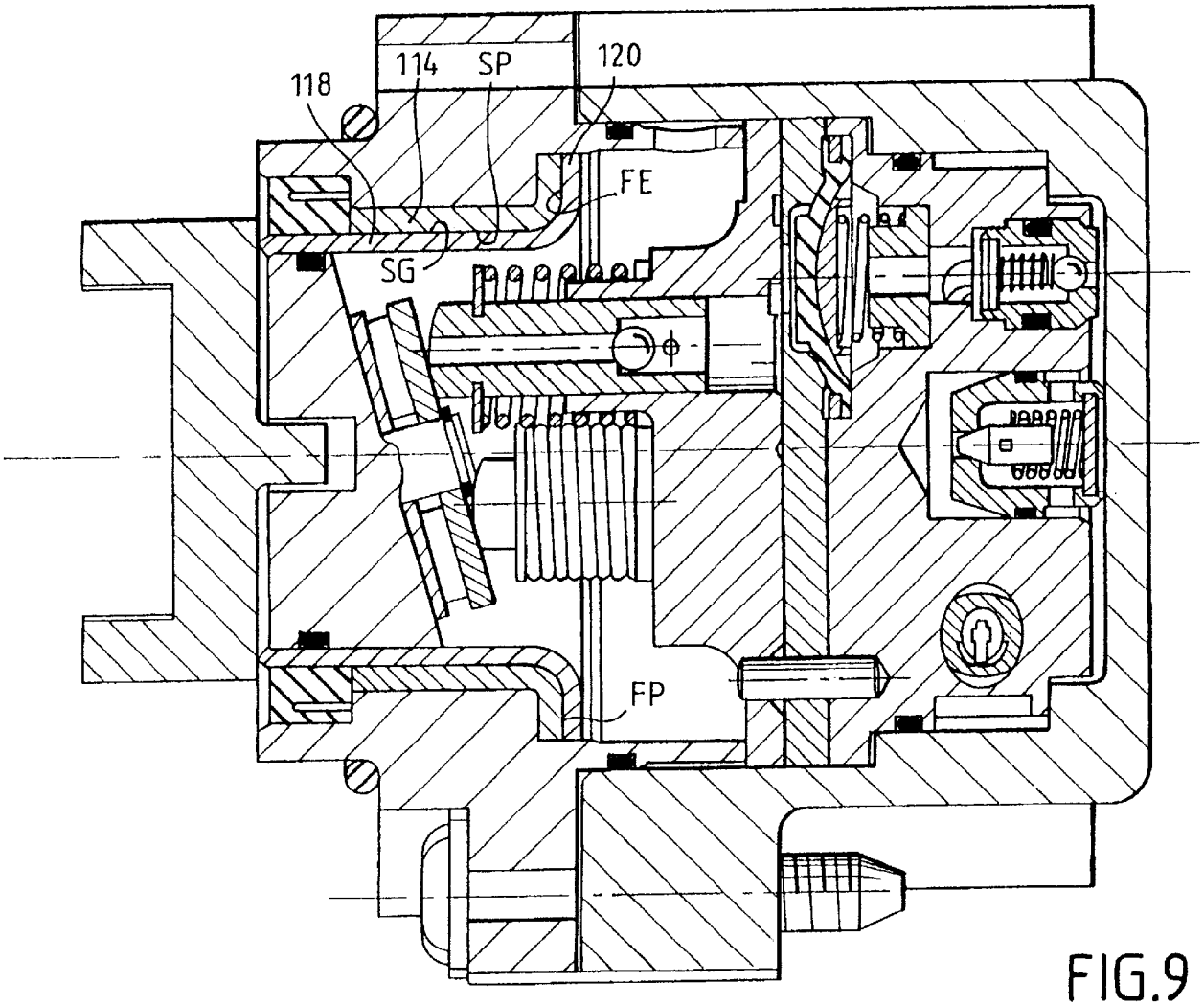

According to a second alternative form depicted in FIG. 9, the peripheral guide surface SG for the hub is formed by the external surface of a sleeve 118, in which the swashplate 62 is housed, equipped with an end extended by a collar 120 delimiting the shoulder FE for axially positioning the hub. The sleeve 118 of the hub collaborates with a sleeve 114 secured to the housing body 22 of the type depicted in FIG. 8.

Figure 10:
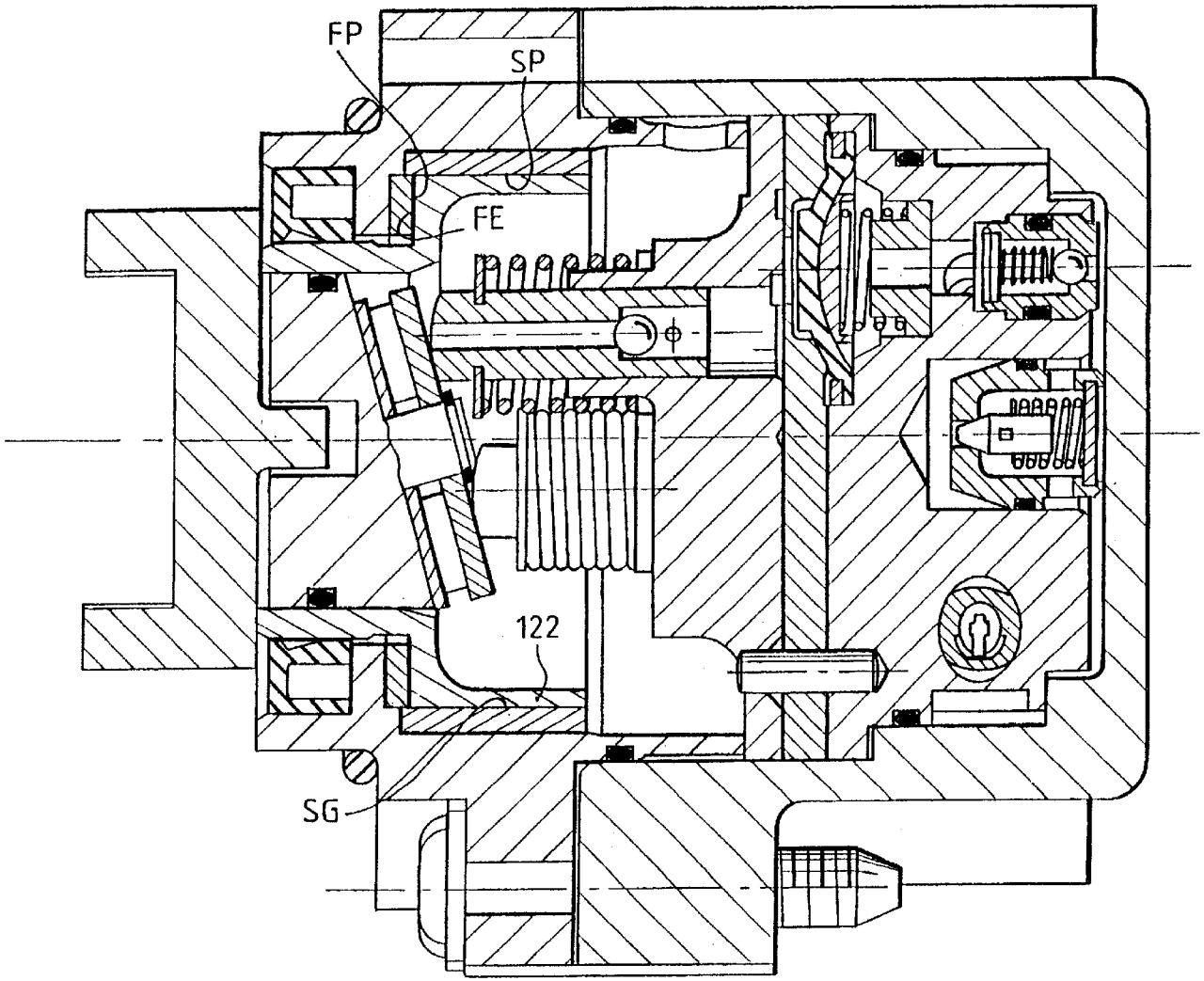
Figure 11:
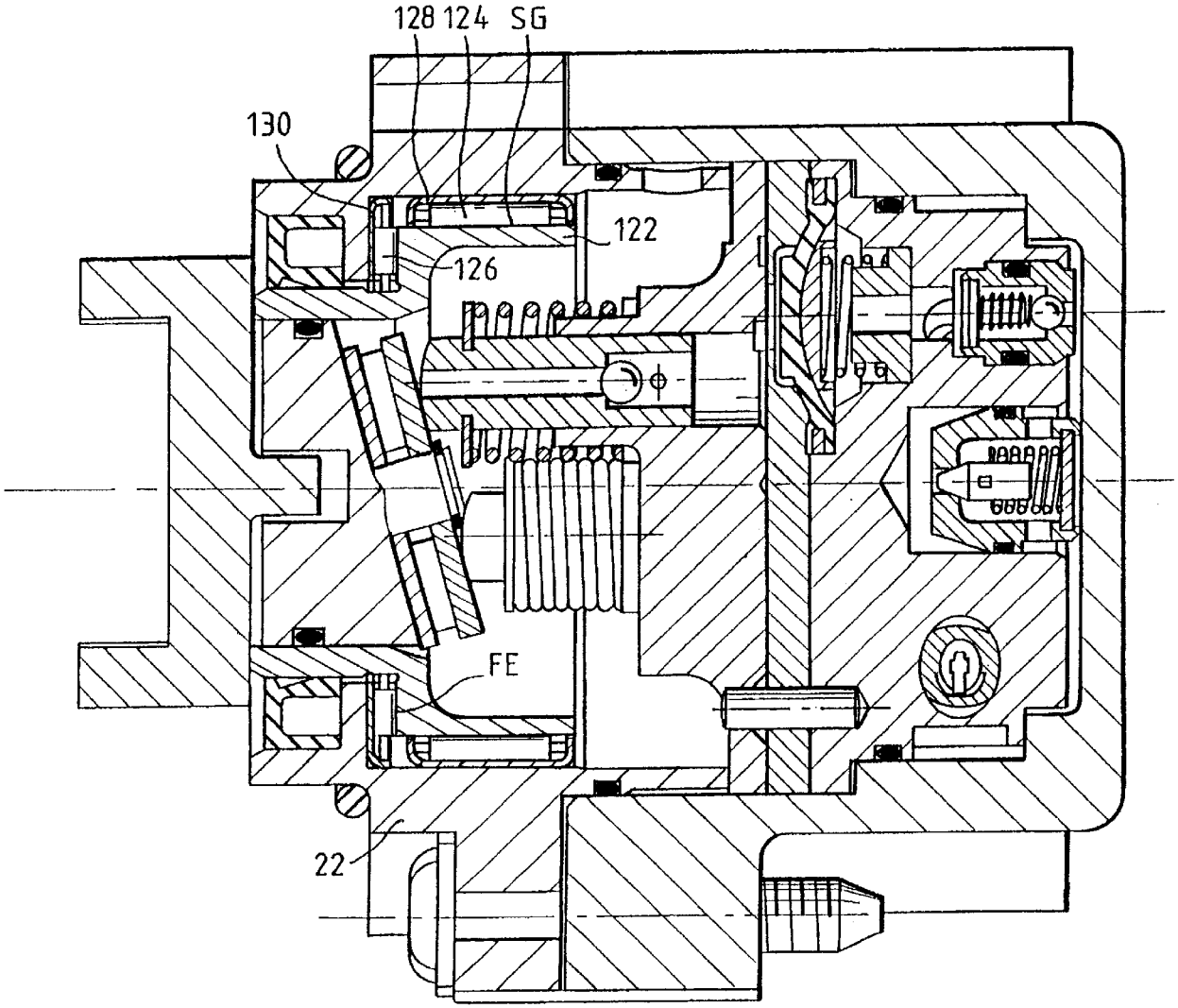

According to the third and fourth alternative forms depicted in FIGS. 10 and 11 respectively, the peripheral guide surface SG and the axial positioning shoulder FE for the hub are formed by the external surface of a stepped tubular member 122, made as a single piece, in which the swashplate 62 is housed. The stepped member 122 may be manufactured easily in a conventional way, particularly by drawing, treatment and grinding.

In the third alternative form depicted in FIG. 10, the stepped member 122 is in sliding contact with a cylindrical bearing surface SP and a flat bearing surface FP formed on elements similar to those depicted in FIG. 3.

In the fourth alternative form depicted in FIG. 11, the peripheral guide surface SG of the stepped member 122 is in contact with rolling bearing needles 124 running more or less parallel to the axis X, and the axial positioning shoulder FE is in contact with rolling bearing needles 126 running more or less radially with respect to the axis X.

The needles 124, 126 are carried by cages 128, 130 fixed in a manner known per se to the housing body 22.

Amongst the advantages of the invention, it will be noted that the means for rotationally guiding and axially positioning the hub with respect to the housing of the pump according to the invention are simple, easy to manufacture and therefore inexpensive. In addition, these means are compact, relatively light and silent.

What is claimed is:

1. A high-pressure pump for pumping a first liquid, known as the transferred liquid, of the type comprising a main unit (18) for pumping the transferred liquid, which unit is actuated by a secondary unit (20) for pumping a second liquid, known as the working liquid, the secondary unit (20) comprising a hub (64) mounted so as to rotate in a housing (16) forming a bearing, and at least one piston (54) for compressing the working liquid, which can move approximately parallel to the axis (X) of rotation of the hub, returned elastically against a swashplate (62) for actuating this piston (54), carried by the hub, characterized in that the hub (64) comprises a peripheral cylindrical surface (SG) for guiding the rotation in the housing (16), extended by a shoulder (FE) for axially positioning the hub in the housing (16), the peripheral guide surface (SG) and the axial positioning shoulder (FE) cooperating respectively with complementary rotational guiding means (SP; 124) and complementary axial positioning means (FP; 126) carried by the housing (16), the axial positioning shoulder (FE) being urged against the complementary axial positioning means (FP; 126) carried by the housing (16) and by the elastic return force of the piston (54) and the pressure of the working liquid in contact with the swashplate (62).

2. The pump as claimed in claim 1, characterized in that the peripheral guide surface (SG) is formed by the external surface of a sleeve (106), the axial positioning shoulder (FE) being formed by one face of a ring (108) attached to this sleeve (106).

3. The pump as claimed in claim 1, characterized in that the peripheral guide surface (SG) and the axial positioning shoulder (FE) are formed by the external surface of a stepped tubular member (122) made as a single piece.

4. The pump as claimed in claim 1, characterized in that the peripheral guide surface (SG) is formed by the extern al surface of a sleeve (118), the axial positioning shoulder (FE) being delimited by a collar (120) extending one end of this sleeve (118).

5. The pump as claimed in claim 1, characterized in that the complementary rotational guiding means comprise a cylindrical bearing surface (SP) in sliding contact with the peripheral guide surface (SG) for the hub (64) and the complementary axial positioning means comprise a flat bearing surface (FP) in sliding contact with the shoulder (FE).

6. The pump as claimed in claim 5, characterized in that the cylindrical bearing surface (SP) is formed by the internal surface of a liner (110) of the housing (16), the flat bearing surface (FP) being formed by a washer (112) arranged at one end of the liner (110).

7. The pump as claimed in claim 5, characterized in that the cylindrical bearing surface (SP) is formed by the internal surface of a sleeve (114), the flat bearing surface (FP) being delimited by a collar (116) extending one end of the sleeve (114).

8. The pump as claimed in claim 1, characterized in that the complementary rotational guiding means comprise rolling bearing needles (124), carried by the housing (16) running more or less parallel to the axis of rotation of the hub (64), and the complementary axial positioning means comprise rolling bearing needles (126), carried by the housing (16), running more or less radially with respect to the axis of rotation of the hub (64).

9. The pump as claimed in claim 1, characterized in that the transferred liquid is a fuel for a motor vehicle internal combustion engine.

* * * * *